US005642887A

United States Patent [19]

Orav

[11] Patent Number: 5,642,887

[45] Date of Patent: Jul. 1, 1997

[54] GAME DART WITH RETRACTABLE FLIGHT SECTION

[76] Inventor: Mihkel Orav, 12210 Bean Rd., Munson, Ohio 44024

[21] Appl. No.: 657,535

[22] Filed: Jun. 4, 1996

[51] Int. Cl.[6] ..... A63B 65/02

[52] U.S. Cl. ..... 473/586

[58] Field of Search ..... 273/416, 420, 273/423

[56] References Cited

U.S. PATENT DOCUMENTS

| | | | |
|---|---|---|---|
| 3,596,910 | 8/1971 | Rizzo | 273/420 |
| 4,101,126 | 7/1978 | Kurtz et al. | 273/419 X |
| 4,109,915 | 8/1978 | Bottelsen | 273/420 |
| 4,181,303 | 1/1980 | Sjogren | 273/420 |
| 4,230,322 | 10/1980 | Bottelsen | 273/420 |
| 4,596,393 | 6/1986 | Orav | 273/420 |
| 4,842,285 | 6/1989 | Farler | 273/420 |
| 4,978,130 | 12/1990 | Farler | 273/423 |
| 5,324,044 | 6/1994 | Giegerich | 273/423 |
| 5,419,567 | 5/1995 | Orav | 273/420 |

*Primary Examiner*—William H. Grieb
*Attorney, Agent, or Firm*—Howard D. Gordon

[57] ABSTRACT

A game dart (10) is provided with a flight section (24) extending axially rearwardly from the rearward end (32) of a body section (20) and having at least a portion thereof (38/40) axially movable relative to the body section to minimize or eliminate bounce-outs or deflections or subsequently thrown darts striking a previously thrown dart embedded in a target.

7 Claims, 5 Drawing Sheets

FIG. 2
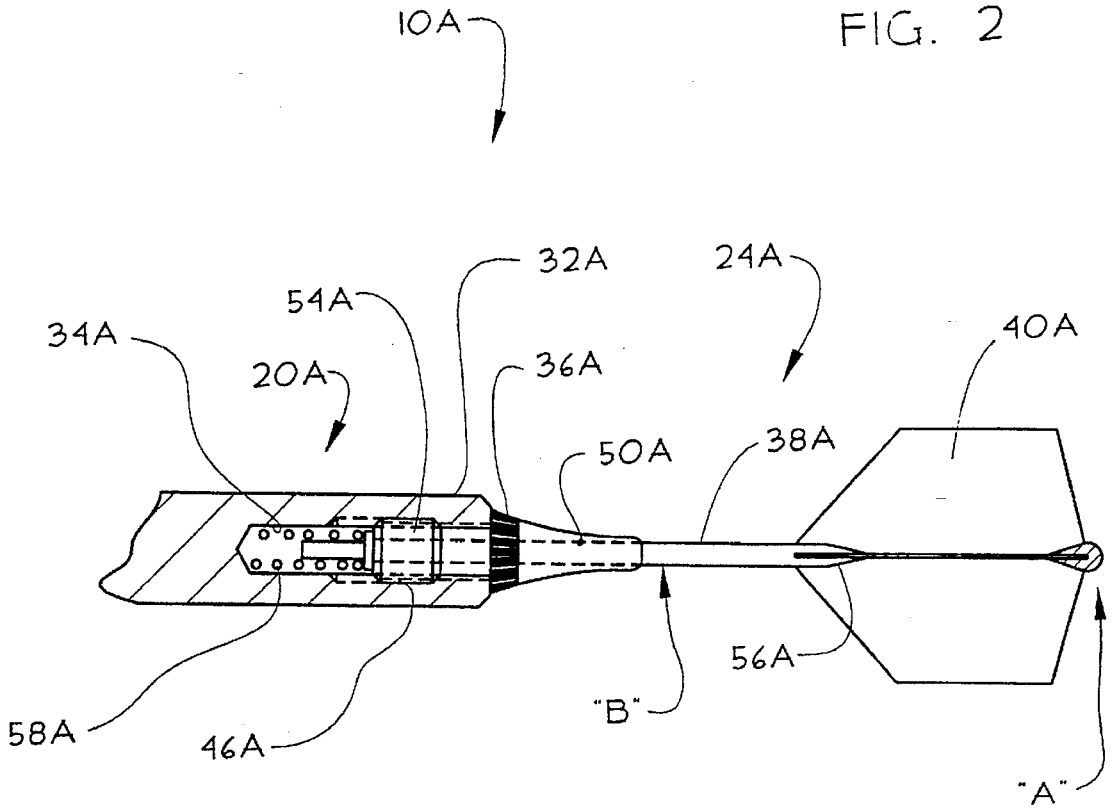
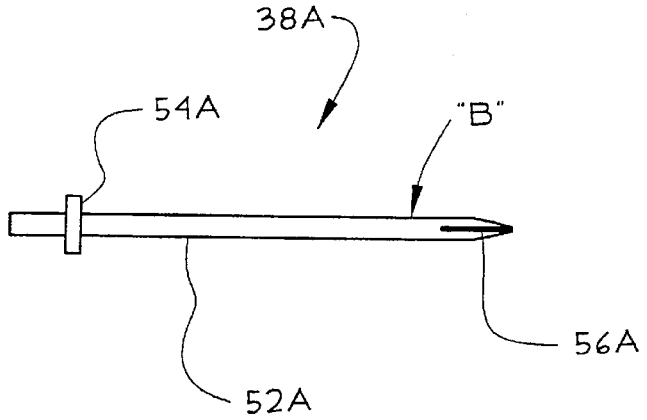
FIG. 2A

FIG. 4
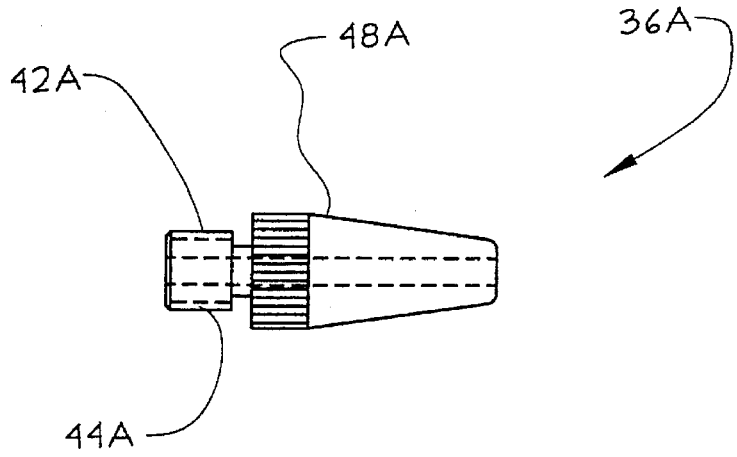
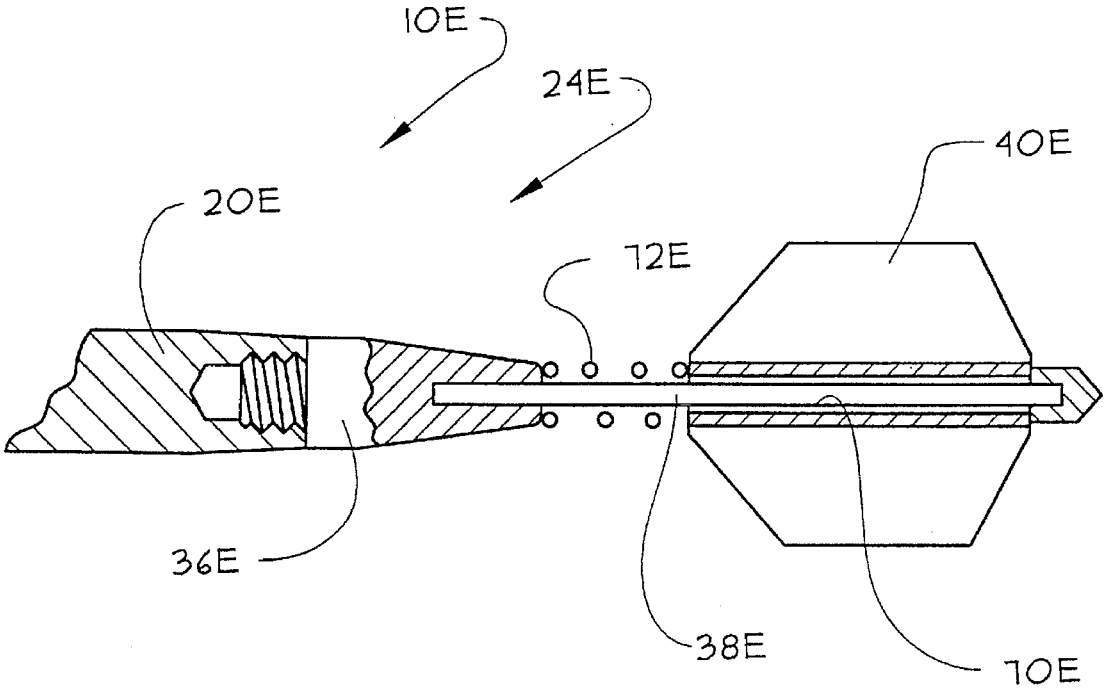
FIG. 7

FIG. 5
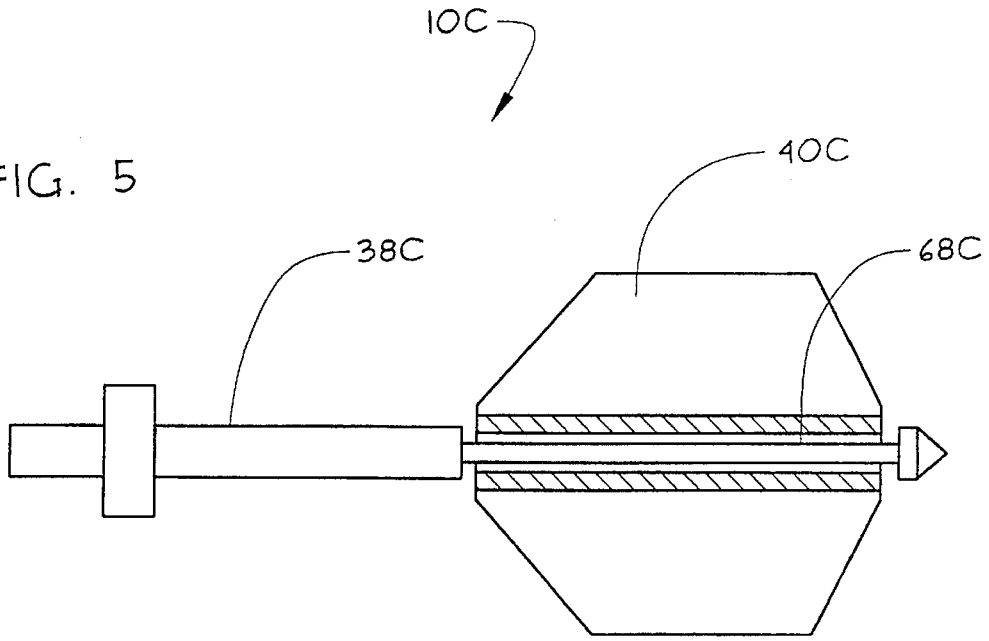
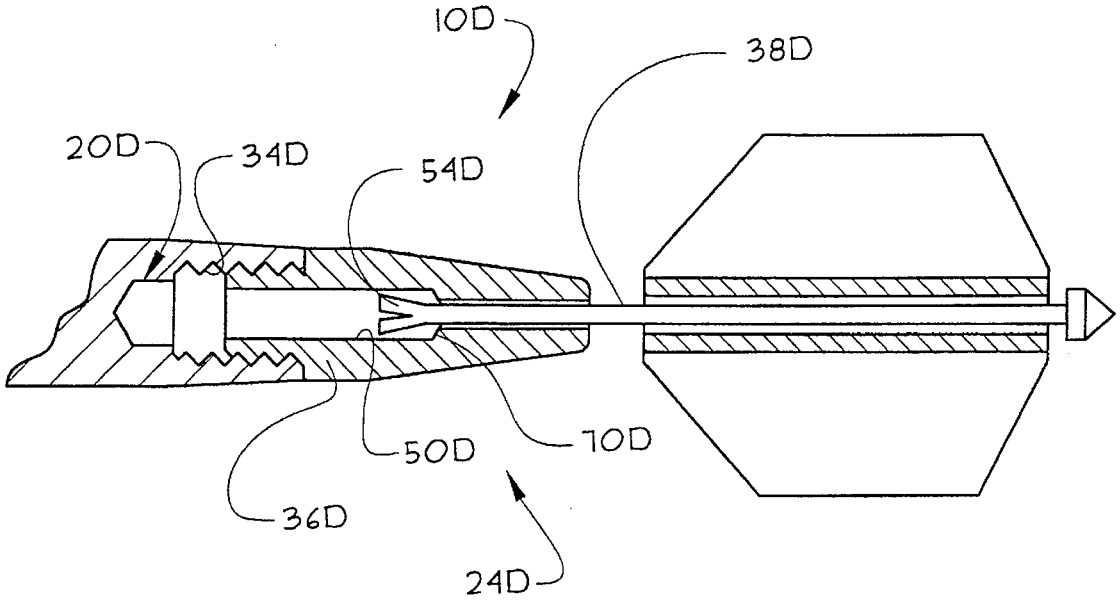
FIG. 6

GAME DART WITH RETRACTABLE FLIGHT SECTION

BACKGROUND OF THE INVENTION

1. Field of the Invention

The present invention relates to game darts utilized with dartboards and, more particularly, to game darts having a flight section, or portion of a flight section, retractable relative to the body section to minimize bounce-outs and/or deflections of subsequently thrown darts striking the flight section of a previously thrown dart embedded in the dartboard. Preferably, the flight will be rotatable relative to the body section to further minimize bounce-outs and/or deflections of subsequently thrown darts striking the flights of a previously thrown dart embedded in the dartboard.

2. Description of the Prior Art

The game of darts is played as a competitive contest throughout the world. Many players are quite skilled in throwing a dart at a designated or desired location on a dartboard. The dartboards employed by serious players of the game incorporate a plurality of metal ribs to define target patterns for the board, and many games of darts require the participants to hit within predetermined target areas whose boundaries are defined by the metal ribs. As such, the ribs are fabricated from steel wire of a diameter between one and two or more millimeters. As will be described, the total area covered by these ribs is a considerable portion of the board area. Hence, players often hit a metal rib with the dart point. This often causes the dart to bounce off the board and, hence, the player receives no score. It is also determined that the better the player is, the more bounce-off he/she will experience due to the object and formats of various dart contests or games.

Various anti-bounce-off or anti-bounce-back game darts are known in the prior art. Previously, these included two general types of game darts: darts utilizing point sections axially movably mounted in the body sections (as seen in U.S. Pat. Nos. 4,109,915; 4,181,303 and 4,230,322, the disclosures of which are incorporated herein by reference) and darts utilizing point sections resiliently pivotably mounted in body sections (as seen in U.S. Pat. No. 4,101,126, the disclosure of which is incorporated herein by reference).

More recently, a third type of anti-bounce-back game dart was introduced, utilizing point sections mounted for simultaneous axial and rotational movement relative to the body sections. Anti-bounce-back game darts of this type are seen in U.S. Pat. Nos. 4,596,393; 4,842,285 and 5,419,567, the disclosures of which are incorporated herein by reference.

While the prior art anti-bounce-back game darts are effective to minimize or prevent bounce-outs due to striking wires or staples on the dartboard, they were not totally satisfactory to prevent or minimize deflections or bounce-outs due to striking flight sections of previously thrown darts embedded in the target area of the dartboard.

SUMMARY OF THE INVENTION

In accordance with the present invention, the drawbacks of the prior art are overcome or minimized by the provision of an improved game dart having a point section, a body section and a flight section extending rearwardly from the body section wherein the flight section, or a portion thereof, is axially retractable relative to the body portion to minimize bounce-outs or deflections of subsequently thrown darts striking the flight sections of previously thrown darts embedded in the dartboard. Preferably, the flight is mounted for rotational movement relative to the body to further minimize bounce-outs and deflections of later thrown darts.

The foregoing is accomplished, in a preferred embodiment, by providing a flight section comprising a base portion for attachment to the body section, a shaft portion extending rearwardly from the base portion and a flight carried by the shaft portion. The shaft portion is axially movable relative to the body section and is resiliently and/or resiliently deformably retained in rearward most axial position relative to the body section. In another preferred embodiment, the shaft portion is fixed relative to the body section, and the flight is axially movable on the shaft portion and resiliently biased to a relatively rearward position thereon.

Accordingly, it is an object of the present invention to provide an improved game dart which will minimize bounce-outs or deflections of subsequently thrown darts.

This and other objects and advantages of the present invention will become apparent from a reading of the description of the preferred embodiment taken in connection with the attached drawings.

BRIEF DESCRIPTION OF THE DRAWINGS

FIG. 2 is an enlarged sectional view of a first embodiment of the present invention.

FIG. 2A is an enlarged view of the shaft portion of the flight section of the game dart of FIG. 2.

FIG. 4 is an enlarged view of the base portion of the flight section of the game dart of the present invention.

FIG. 5 is an enlarged view of an alternate shaft portion.

FIG. 6 is an enlarged partial view of an alternate embodiment of the present invention.

FIG. 7 is an enlarged partial view of another alternate embodiment of the present invention.

DESCRIPTION OF THE PREFERRED EMBODIMENT

In the following description of the preferred embodiment, certain terminology will be utilized for purposes of reference only and are not intended to be limiting. For example, the terms "forward" and "rearward" will refer to the direction in which a dart is normally thrown. The terms "inward" and "outward" will refer respectively to directions towards and away from the geometric center of the device being described. This applies to the terms specifically mentioned above, derivations thereof and to words of similar import.

Figure 1:
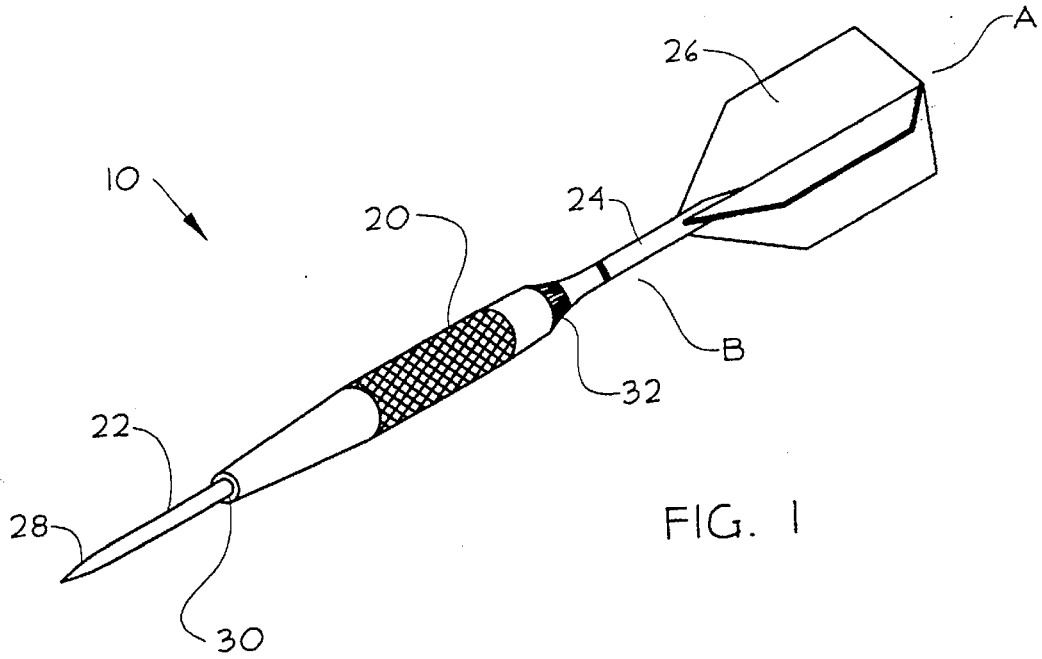
FIG. 1 is a perspective view of the game dart of the present invention.
Figure 1A:
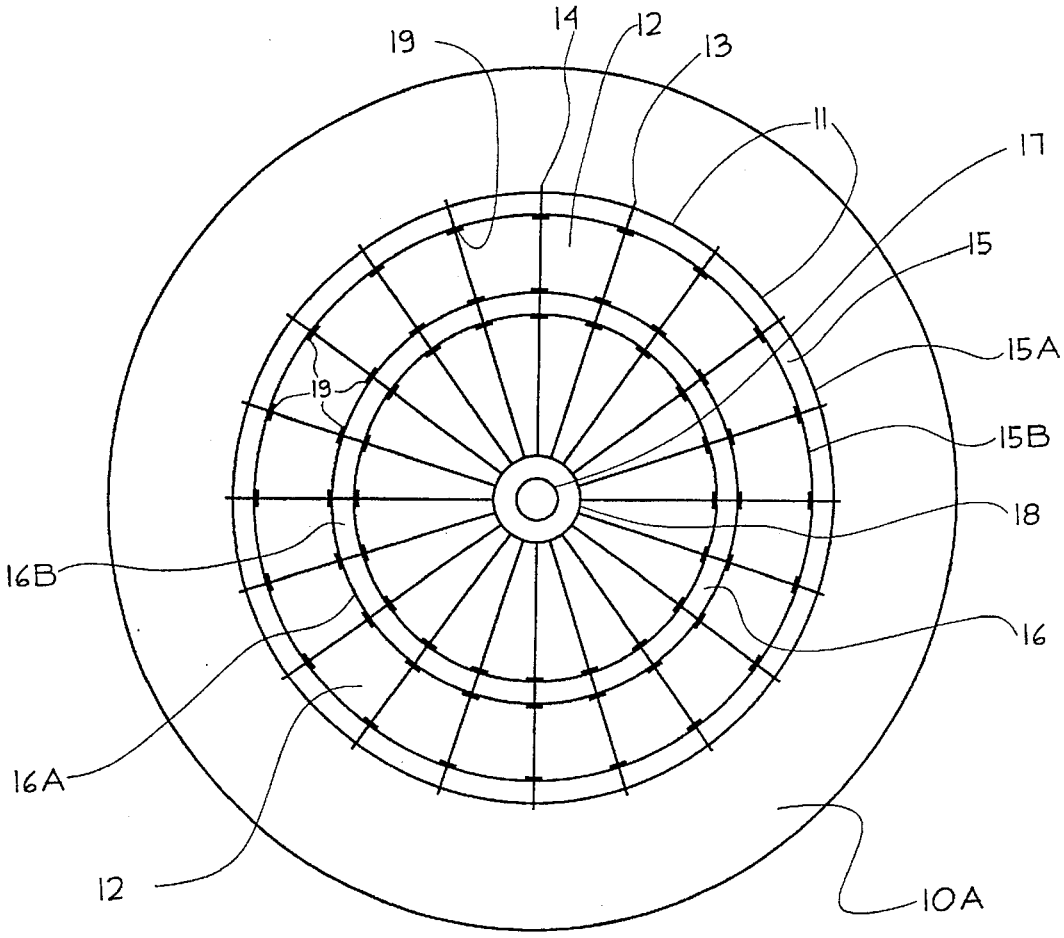
FIG. 1A is a frontal view of a typical dartboard.

The game dart 10 of the present invention, and a typical dartboard 10A used therewith, are illustrated in FIGS. 1 and 1A, respectively.

Referring to FIG. 1A, there is shown a typical tournament type of dartboard 10A. Boards such as 10A are constructed from a penetrable material such as jute, cork and so on to permit a pointed dart to enter the board and be held in place by the board material. The operation of a dart and dartboard is considered to be well known. The dartboard 10A is usually about 40 or more centimeters in diameter and has a plurality of metal wire ribs 11 defining target patterns.

Essentially, the board 10A contains twenty equal pie-shaped areas as 12. Each area as 12 is bounded by two radial metal ribs as 13 and 14. Each rib 13 and 14 is approximately one to two or more millimeters in diameter and is fabricated from a steel wire of a circular cross-section. An outer ring area 15 is located about sixteen centimeters from the center of the board. The outer ring area 15 is defined by an outermost metal rib 15A and an inner rib 15B. The distance between the ribs 15A and 15B is approximately one centimeter.

An inner ring area 16 is located about ten centimeters from the center and is defined by an outer ring 16A and an inner ring 16B. The distance between the rings 16A and 16B or the inner area 16 between the rings is also about one centimeter.

There is a center bull's-eye area 17 and a concentric area 18. Area 17 is about 1.5 centimeters in diameter, with area 18 being about 3.5 centimeters in diameter. The entire metal grid is held in place on the board 10A by a series of staples as 19 which are usually of the same material as the wire grids. It, thus, is indicated that in a board as 10A, the entire grid depicted is formed by steel wire of approximately 1 to 2 millimeters in diameter with a circular cross-section.

As can be ascertained, the wire grid depicted covers a reasonable portion of the board 10A. If a player, upon throwing a conventional dart, strikes a metal grid wire 11, the dart often bounces off and does not secure itself into the board 10A. For the bounce-off, the player receives no score. Furthermore, the point of the dart may be damaged by striking the metal grid wires. The same often will occur upon striking the flight section of a previously thrown dart embedded in the board.

Anti-bounce-back game darts of the type described in aforementioned U.S. Pat. Nos. 4,596,393; 4,842,285 and 5,419,567 are effective to minimize the problem of bounce-outs due to striking wires or staples. The game dart 10 of the present invention, which may be of the fixed point section type or of the movable point section type, is intended to minimize bounce-outs or deflections of subsequently thrown darts. Referring to FIG. 2, points "A" and "B" ware areas of embedded darts typically struck by subsequently thrown darts, resulting in bounce-outs or deflections of a subsequently thrown dart.

The game dart 10 of the present invention includes a body or barrel section 20, a point section 22 extending axially from the body section 20, and a tail section 24 which carries the flight elements 26, which may be separable or integral with the tail section. The free end of point section 22 is provided with a tapered pointed tip 28 for penetration of a target, such as dartboard 10A. The body section 20 defines a forward end 30 and a rearward end 32.

Game darts and dartboards of this general type, and the games played therewith, are well known in the prior art and may be appreciated by reference to aforementioned U.S. Pat. Nos. 4,101,126; 4,109,915; 4,181,303; 4,230,322; 4,596,393 and 4,842,285, the disclosures of which are incorporated herein by reference.

In the following description of the structural details of the various embodiments of the game dart of the present invention, elements having similar or identical structures and functions will be assigned like reference numerals with an appropriate letter appended thereto.

In the first embodiment 10A of the game dart of the present invention, as seen in FIG. 2, the body section 20A is provided with a cavity 34A opening to the rearward end 32A thereof for receiving the flight section 24A. The flight section 24A includes a base portion 36A, a shaft portion 38A and a flight 40A.

The base portion 36A (see FIG. 4) includes a reduced outer diameter area 42A carrying external threads 44A for threadable attachment to internal threads 46A provided in the cavity 34A, and an enlarged diameter area 48A matching the outer diameter of the rearward end 32A of the body and tapering radially inwardly and rearwardly therefrom. The enlarged diameter area 48A may be provided with an external knurled surface. An axially extending through bore 50A is provided in the base portion.

The shaft portion 38A includes an elongated shaft 52A for receipt in bore 50A of the base portion, a flanged or headed area 54A of a larger diameter than bore 50A, and a slotted area 56A for removably retaining the flights.

A compression spring 58A is received in cavity 34A and bears against flanged area 54A to resiliently bias the flanged area against the forward area 46A of the base portion and the flight section 24A rearwardly relative to body section 20A.

As may be seen by reference to FIG. 2, the flight section 24A, upon being struck by a subsequently thrown dart, may retract relative to body section 20A to minimize bounce-outs or deflections of the subsequently thrown dart. The flight section retracts as the shaft portion 38A moves forward in cavity 34A against the resilient bias of spring 58A.

Figure 3:
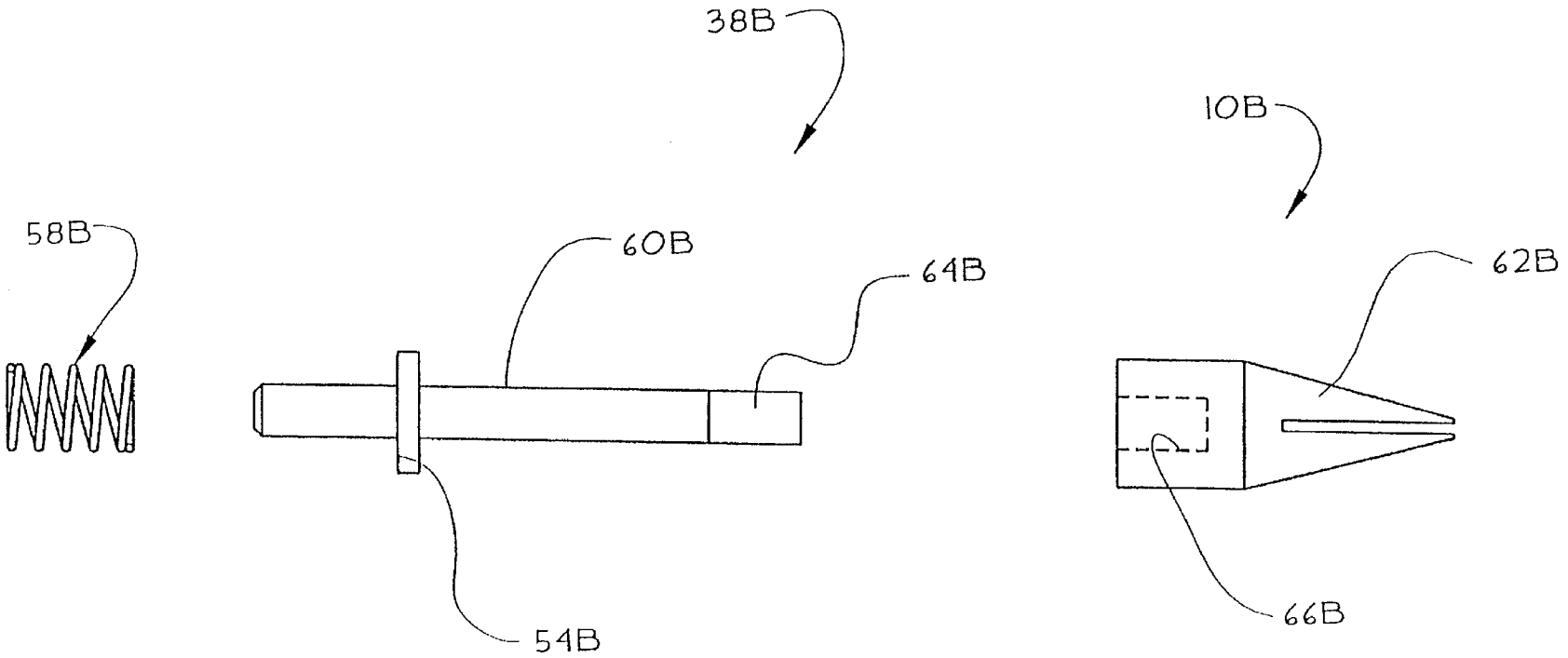
FIG. 3 is an exploded partial view of an alternate embodiment of the present invention.

FIG. 3 illustrates, in a partial exploded view, an alternate embodiment 10B of the present invention. The shaft portion 38B comprises two pieces, a forward piece 60B including the flanged area and a slotted rearward piece 62B for retaining the flight. The rearward end 64B of the shaft portion is reduced and may be of a rectangular or "D" shape, or the like, to receive the forwardly opening inner bore cavity 66B defined in the end piece 62B in a light press fit. Alternatively, both the end 64B and cavity 66B may be annular, allowing the end piece 62B and the flight to rotate relative to the body section if struck by a subsequently thrown dart.

Another alternate embodiment of the present invention 10C is partially illustrated in FIG. 5. In FIG. 5, the rearward end 68C of the shaft portion 38C is provided with a reduced annular portion for reception of a bore defined by rotatable flight 40C. This type of flight may be seen in greater detail by reference to U.S. Pat. No. 5,324,044, the disclosure of which is incorporated herein by reference.

A further embodiment 10D of the present invention is partially illustrated in FIG. 6. The rear end 68D of the shaft portion 38D and flight 40D are substantially identical to that illustrated in FIG. 5. The body 20D includes a rearwardly opening cavity 34D which threadable receives a base portion 36D having a stepped through bore 50D defining a shoulder 70D for resiliently retaining a headed area 54D of shaft portion 38D to resiliently, deformably retain the flight section 24D in the rearwardmost position thereof relative to the body section 20D.

FIG. 7 illustrates a further embodiment 10E of the present invention. The flight section 24E is threadably attached to the body section 20E and includes a base portion 36E, a fixed shaft portion 38E and a flight 40E. The shaft portion 38E is of a constant outer diameter and received in a bore 70E defined in the flight, allowing the flight to move axially on the shaft portion. A compression spring 72E biases the flight 40B rearwardly on the shaft portion against the rear stop 74E of the shaft portion.

The structure of the game dart of the present invention allows assembly and removal of the flight sections by simply threadably removing and then reattaching the tail sections 24 from and to the body section 22.

Although the present invention has been described with a certain degree of particularity, it is understood that the description of the preferred embodiment is by way of example only and that numerous changes to form and detail are possible without departing from the spirit and scope of the invention as hereinafter claimed.

I claim:

1. A game dart comprising (i) a body section defining a forward end and a rearward end, (ii) a point section having a pointed tip extending axially outwardly from the forward end of said body section, (iii) a flight section extending axially outwardly from the rearward end of said body section and having at least one portion axially movable in said body section from a first axially rearward position to a second axially forward position, and (iv) mounting means associated with said flight section portion and said body section for mounting said at least one portion of said flight section to said body section with limited relative axial movement therebetween and effective to releasably retain said at least one portion of said flight section in, and resiliently bias said at least one portion of said flight section toward, the axially rearward position thereof.

2. The game dart of claim 1 wherein said mounting means comprises a coil spring.

3. The game dart of claim 1 wherein said flight section comprises a base portion mounted to the rearward end of said body section, a shaft portion and a flight, said flight rotatable relative to said body section.

4. The game dart of claim 3 wherein said flight section comprises a base portion mounted to the rearward end of said body section, a shaft portion and a flight mounted to said shaft, said shaft portion and said flight axially movable as a unit relative to said body section.

5. The game dart of claim 1 wherein said flight section comprises a base portion mounted to the rearward end of said body section, a shaft portion and a flight mounted to said shaft, said shaft portion and said flight axially movable as a unit relative to said body section.

6. A game dart comprising:

a body section defining a forward end and a rearward end;

a point section having a pointed tip extending axially outwardly from the forward end of said body section;

a flight section mounted to the rearward end of said body section and extending axially outwardly therefrom, said flight section comprising a base portion mounted to said rearward end of said body section, a shaft portion fixed to said base portion and a flight carried by said shaft portion, said flight axially movable relative to said shaft portion from an axially rearward position to an axially forward position; and mounting means associated with shaft portion and said flight for releasably retaining said flight in the rearward position thereof, said mounting means comprising a spring for resiliently biasing said flight toward said rearward position thereof.

7. The game dart of claim 6 wherein said flight is rotatable relative to said shaft portion.

* * * * *